US005217213A

United States Patent [19]

Lii

[11] Patent Number: 5,217,213

[45] Date of Patent: Jun. 8, 1993

[54] QUICK RELEASE C-CLAMP

[76] Inventor: Liang-Kuen Lii, 58, Ma Yuan West St., Taichung, Taiwan

[21] Appl. No.: 884,539

[22] Filed: May 18, 1992

[51] Int. Cl.[5] ..... B66F 3/00

[52] U.S. Cl. ..... 269/6

[58] Field of Search ..... 269/6, 3, 249, 216, 269/228, 143; 254/108; 222/325-327, 391

[56] References Cited

U.S. PATENT DOCUMENTS 3,144,707 8/1964 Hiestand ..... 254/108
3,197,848 8/1965 Eichacker ..... 254/108
4,874,155 10/1989 Goul ..... 269/6

*Primary Examiner*—Robert C. Watson

[57] ABSTRACT

A C-clamp including a grip fixed to a body, a rod laterally extended through the upper end of the grip and extended into the body, a rack formed in the rod, a handle having an upper end pivotally coupled to the grip, a pawl pivotally coupled in the upper end of the handle for engagement with the rack, a catch disposed in the grip and engaged with the rack for preventing backward movement of the rod, whereby, the rod is pushed forward when the handle pulled toward the grip, and the rack is disengaged from the pawls when the rod is rotated.

1 Claim, 4 Drawing Sheets

QUICK RELEASE C-CLAMP

BACKGROUND OF THE INVENTION (a) Field of the Invention

The present invention relates to a C-clamp, and more particularly to a quick release C-clamp.

(b) Description of the Prior Art

A typical C-clamp is shown in FIG. 4 and comprises a C-shaped body 1 having a screw hole 2 formed therein for threadedly engaging a bolt 3. The threaded and unthreaded operations of the bolt 3 is slowly.

In order to solve the problem, one type of quick release C-clamp is developed as shown in FIG. 5 and comprises a C-shaped body 4 having an extension 42 formed on one end thereof, an opening 421 formed in the extension 42, a rod 6 laterally engaged in the extension 42 and extended through the opening 421 of the extension 42, a first disc 52 engaged on the rod 6 and located in the opening 421, a first spring 61 engaged in the opening 421 for biasing the first disc 52, a second disc 53 engaged on the rod 6 and located outside of the body 4 and having an edge engaged with a stop 422 formed integral with the extension 42, a second spring 62 engaged on the rod 6 for biasing the second disc 53, and a handle 51 pivotally coupled to the extension 42 and having one end 511 engaged with the first disc 52, and a third spring 41 disposed for biasing the handle 51. In operation, the handle 51 is pulled repeatedly against the spring 41 in order to push the first disc 52 forward, the rod 6 is caused to move forward by frictional engagement between the rod 6 and the first disc 52. The second disc 53 which is inclined relative to the rod 6 prevents the rod 6 from moving backwards. In order to release the rod 6, it is required to straighten the second disc 53 such that the second disc 53 is perpendicular to the rod 6 and such that the rod 6 can be released. The rod 6 will be easily damaged.

The present invention has arisen to mitigate and/or obviate the afore-described disadvantages of the conventional C-clamps.

SUMMARY OF THE INVENTION

The primary objective of the present invention is to provide a quick release C-clamp in which the rod can be operated without frictional engagements.

In accordance with one aspect of the present invention, there is provided a C-clamp comprising a C-shaped body, a grip having an upper end integral fixed to one end of the body, a rod laterally extended through the upper end of the grip and extended into the body, a rack formed lengthwise in the rod, a handle having an upper end pivotally coupled to the grip, means for biasing the handle away from the grip, a first pawl pivotally coupled in an upper end of the handle, means for biasing the first pawl upward to engage the rack of the rod, a second pawl pivotally coupled in the upper end of the grip, means for biasing the second pawl upward to engage the rack of the rod for preventing backward movement of the rod, whereby, the rod is pushed forward by the engagement between the rack and the first pawl when the handle pulled toward the grip, and the rack is disengaged from the pawls when the rod is rotated.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
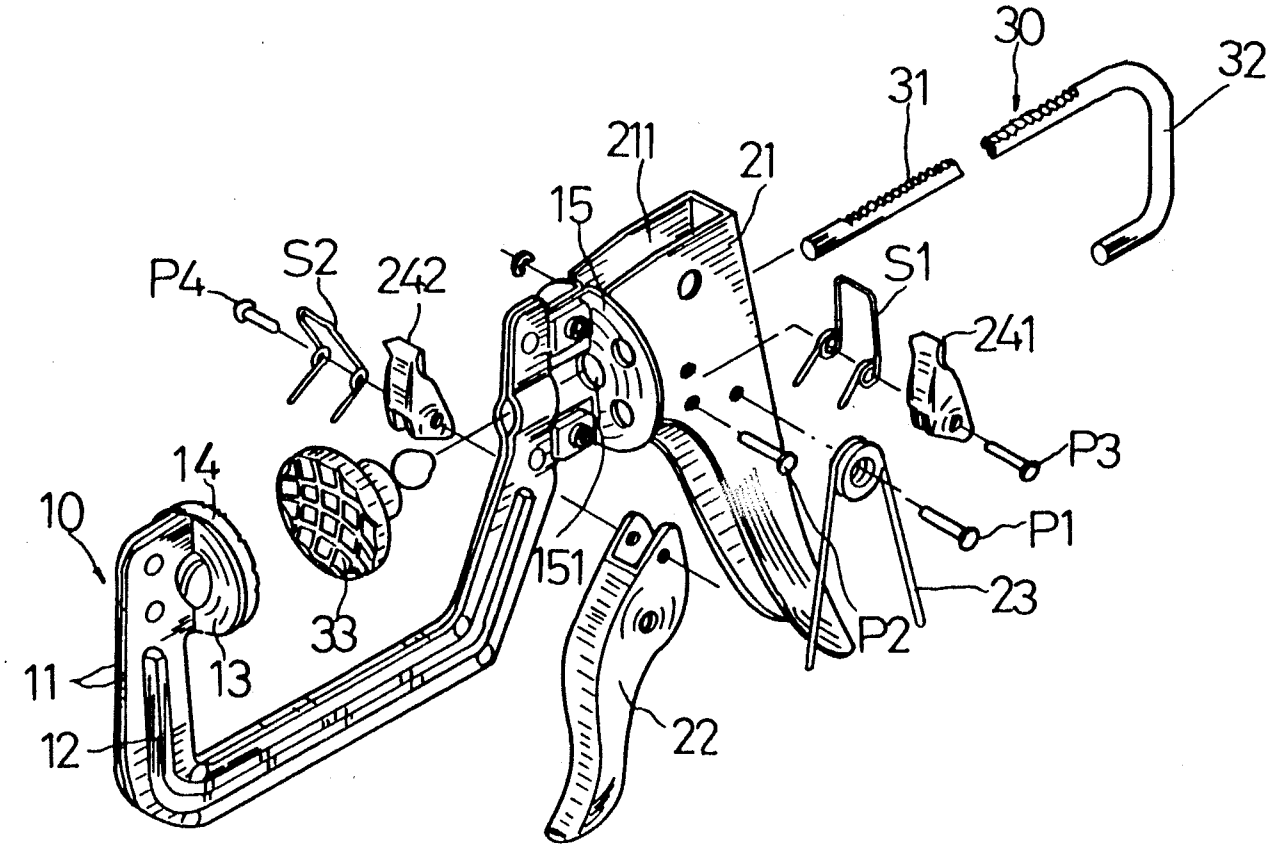
FIG. 1 is an exploded view of a quick release C-clamp in accordance with the present invention.
Figures 2, 3:
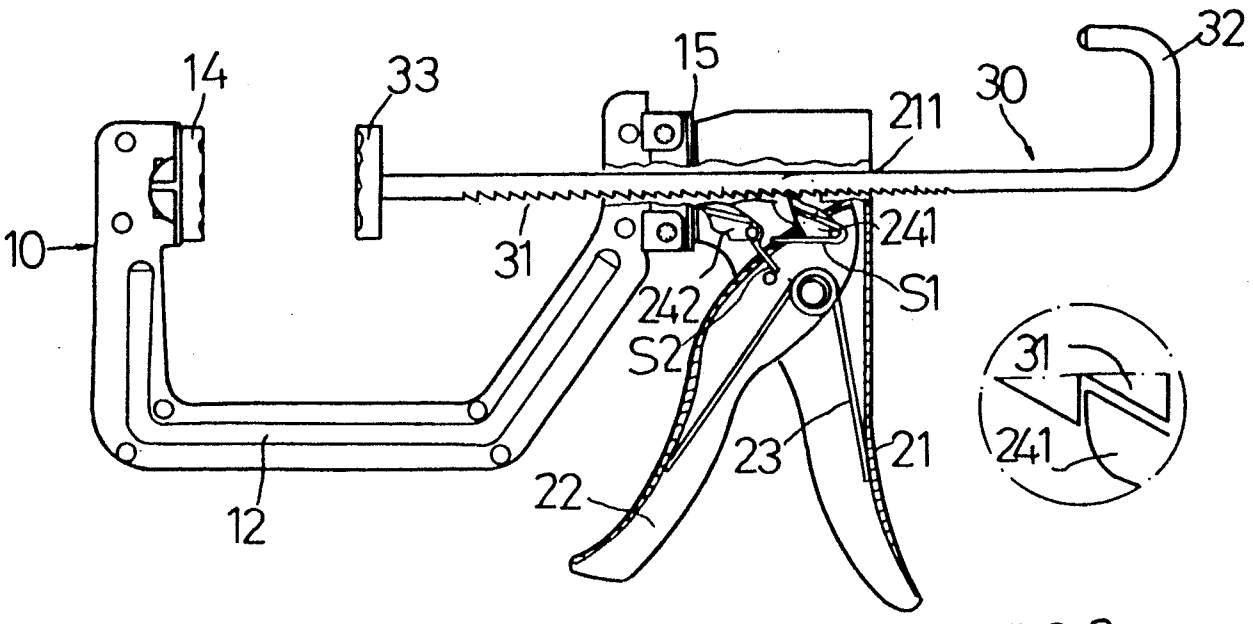
FIG. 2 is a partial cross sectional view of the quick release C-clamp.
FIG. 3 is an enlarged schematic view illustrating the engagement of the rod and a pawl.
Figure 4:
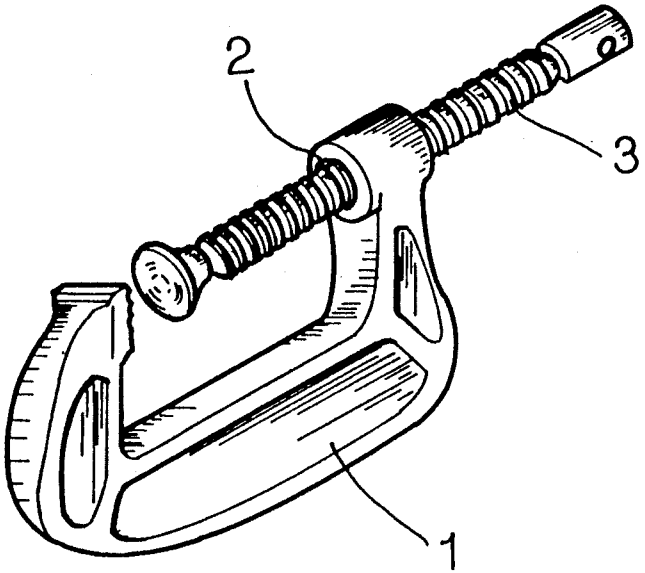
FIG. 4 (PRIOR ART)
FIG. 4 is a perspective view of a conventional C-clamp.
Figure 5:
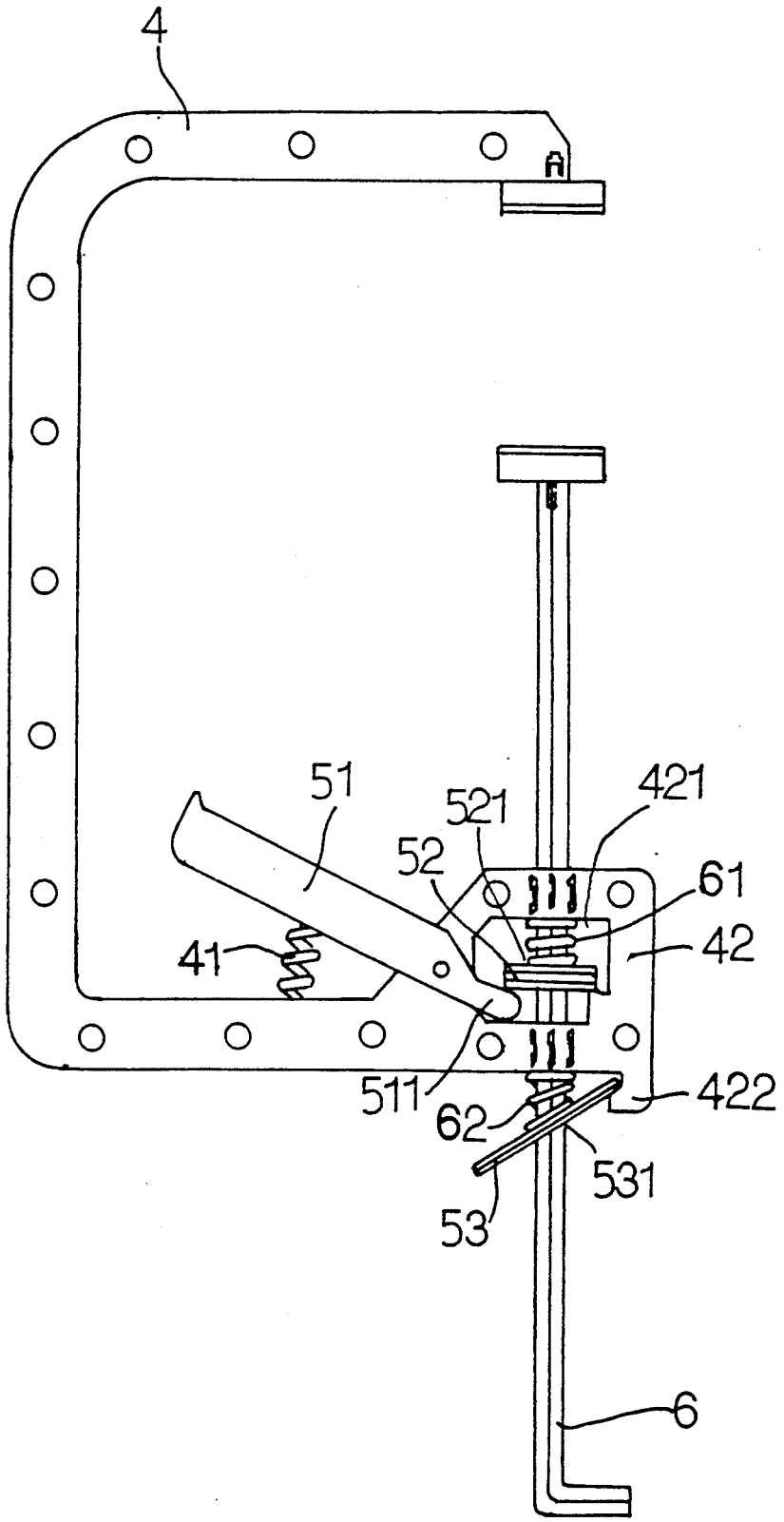
FIG. 5 (PRIOR ART)
FIG. 5 is a plane view of a conventional quick release C-clamp.

Referring to FIGS. 1 to 3, a quick release C-clamp in accordance with the present invention comprises generally a C-shaped body 10 which includes two pieces 11 riveted together and having reinforced ribs 12 formed therein, a disc 13 and a pad 14 integrally fixed on one end of the body 10, a disc 15 integrally fixed on the other end of the body 10, a hole 151 formed in the disc 15, a grip 21 having an upper end integrally fixed to the disc 15 and having a space 211 formed therein, and a handle 22 having an upper end pivotally coupled to the grip 21 by a pin P1, and a spring 23 engaged on the pin P1 for biasing the handle 22 away from the grip 21. A pin P2 is engaged in the space 211 of the grip 21 and located beside the upper end of the handle 22 for limiting the rotating movement thereof caused by the spring 23.

A rod 30 laterally extends through the grip 21 and the hole 151 of the disc 15 and includes a rack 31 formed lengthwise therein, a bent portion 32 formed on one end thereof and a pad 33 formed integral on the other end thereof, the pad 33 is movable toward the pad 14 for clamping an object. A first pawl 241 is pivotally coupled to the upper end of the handle 22 by a pin P3, and a spring S1 is engaged on the pin P3 for biasing the first pawl 241 upward to engage the rack 31 of the rod 30, a second pawl 242 is pivotally engaged in the space 211 of the grip 21 by a pin P4 and a spring S2 is engaged on the pin P4 for biasing the pawl 242 to engage the rack 31 of the rod 30.

In operation, the rod 30 is pushed forward toward the pad 14 by the engagement between the rack 31 and the first pawl 241 when the handle 22 is pulled repeatedly. The engagement between the rack 31 and the second pawl 242 prevents the rod 30 from moving backwards, whereby, the object can be clamped between the pads 14, 33.

When it is required to release the C-clamp, it is only required to rotate the rod 30 with the bent portion 32 such that the rack 31 is disengaged from the pawls 241, 242 and such that the rod 30 can be pulled rearward easily, whereby the C-clamp is released.

Accordingly, the quick release C-clamp in accordance with the present invention includes a pawl 241 for causing the rod 30 to move forwards, the rod 30 will not be damaged. In addition, the rack 31 of the rod 30 can be easily disengaged from the pawls.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A C-clamp comprising a C-shaped body formed by two pieces each having a reinforcement rib formed therein, said body including a first pad fixed integral on a first end thereof and a second end, a grip having an upper end integral fixed to said second end of said body, a rod laterally extended through said upper end of said grip and extended into said body and including a first end having a bent portion formed thereon and a second end having a second pad fixed integral thereon and movable toward said first pad, a rack formed in said rod, a handle having an upper end pivotally coupled to said grip, means for biasing said handle away from said grip, a first pawl pivotally coupled in said upper end of said handle, means for biasing said first pawl upward to engage said rack of said rod, a second pawl pivotally coupled in said upper end of said grip, means for biasing said second pawl upward to engage said rack of said rod for preventing backward movement of said rod, whereby, said rod is pushed forward by the engagement between said rack and said first pawl when said handle pulled toward said grip, and said rack is disengaged from said pawls when said rod is rotated with said bent portion.

* * * * *